US005702275A

United States Patent [19]

Hundertmark

[11] Patent Number: 5,702,275

[45] Date of Patent: Dec. 30, 1997

[54] STEERING MECHANISM

[76] Inventor: James M. Hundertmark, 296 19th St., Fond du Lac, Wis. 54935

[21] Appl. No.: 523,113

[22] Filed: Sep. 1, 1995

[51] Int. Cl.[6] ..... D63H 25/42

[52] U.S. Cl. ..... 440/61; 114/150

[58] Field of Search ..... 440/53, 55, 61, 440/62, 63; 114/150; 180/417, 420, 421, 437, 439, 441, 442

[56] References Cited

U.S. PATENT DOCUMENTS 4,416,637 11/1983 Kashmerick et al. ..... 440/53
5,213,527 5/1993 Fetchko ..... 440/53

*Primary Examiner*—Jesus D. Sotelo
*Attorney, Agent, or Firm*—R. Jonathan Peters

[57] ABSTRACT

A steering mechanism for a marine vehicle operably connected to a propulsion unit, which comprises a hydraulic cylinder having opposed stop members, e.g., end caps, and is supported by a rod extending along the longitudinally axis of the cylinder. A piston is affixed to the support rod and mounted in the cylinder, and fluid passageways open to the cylinder and are spaced longitudinally to each side of the piston to form opposed chambers in the cylinder. The piston is provided with a longitudinal bore extending substantially parallel to the longitudinal axis of the cylinder, so that the bore establishes fluid communication between the opposed chambers. Valve member disposed in the bore is biased to a normally dosed position, but actuated to an open position when the piston is brought into abutting relationship with a stop member thereby establishing fluid communication between the opposed chambers, the valve member and the fluid passageways. A steering arm extends fixedly from the hydraulic cylinder and is connected to the propulsion unit. When hydraulic fluid is selectively transported to either side of the piston mounted on the support rod, the cylinder moves causing accompanying movement of the steering arm, thereby effecting steering movement of the propulsion unit.

5 Claims, 3 Drawing Sheets

STEERING MECHANISM

FIELD OF THE INVENTION

This invention relates to hydraulic steering mechanism for a boat. More specifically, this invention relates to a steering mechanism especially for use with power steering assist and adaptable for marine vehicles.

BACKGROUND AND PRIOR ART

In a conventional steering system such as for outboard motors used on boats, the propulsion unit, typically mounted on the transom of the boat, is pivoted about a vertical steering axis upon steering actuation by the operator at the helm. The propulsion unit comprises a powerhead for housing an engine from which extends a verticallly disposed drive shaft having a propeller, including a rudder, mounted at the end. One typical steering system for a boat having a transom mounted engine comprises a steering cable extending between the steering helm and the propulsion unit so that steering at the helm actuates the cable for causing steering movement of the propulsion unit about a steering axis. A conventional steering cable is the push-pull cable comprising a reciprocative inner core slidable in a protective, flexible outer sheath or housing. One end of the cable is actuably connected to the steering helm, and the other end is actuably connected to the steering mechanism of the propulsion unit. When the wheel is turned at the helm, the cable is actuated by a push-pull movement of the inner core, thereby causing a steering movement of the propulsion unit. Hydraulic activated steering means can be used in place of the cable steering, wherein hydraulic fluid, e.g. oil, is pumped from the steering helm through conduits to a cylinder-piston control means in response to rotation of the steering wheel in one direction or the other. Actuation of the control means actuates the steering mechanism of the propulsion unit, thereby turning the propulsion unit in a common direction. Prior art teaching steering systems of this type include the following U.S. Pat. Nos. 4,592,732; 4,615,290; 4,632,049; 4,568,292; 4,295,833; and 5,074,193; and French patent 1,133,061. Additionally, British Patent Application 2,159,483A discloses a power steering system for an outboard having a hydraulic cylinder-piston assembly and a control valve which is operated by an actuator including a push-pull cable to selectively extend and retract the piston rod and effect steering of the propulsion unit.

More specifically with regards to the teachings in the prior art, typical steering mechanisms for outboard motors are disclosed in U.S. Pat. No. 4,373,920, 4,632,049, and 4,773,882. Generally, the steering mechanism to effect pivoting of the propulsion unit includes a hydraulic cylinder having opposed end caps and mounted longitudinally on a horizontally disposed support rod which is fixed against axial movement by suitable bracketry (but may be tiltable about a horizontal axis). The support rod is provided with a piston which is fixed centrally in the cylinder, and hydraulic conduits opening to the cylinder are spaced on each side of the piston. The hydraulic cylinder is moveable relative to the piston and to the support rod in response to selective application thereto of hydraulic fluid from the operator actuating means through hydraulic conduits connected to the cylinder. The operator actuating means includes a suitable source of pressurized hydraulic fluid, including valve means, for selectively delivering hydraulic fluid to one cylinder end and draining hydraulic fluid from the other cylinder end. The fluid source means can be located remotely from the propulsion unit. A steering arm or tiller arm is fixed at one end to the hydraulic cylinder and at the opposite end to the propulsion unit. Thus, steering actuation causes a resultant fluid pressure differential in the cylinder which serves to move the cylinder relative to the support rod, and in turn actuates the steering arm and thereby pivots the propulsion unit.

For the steering mechanism, it is desirable that the piston be centrally disposed in the cylinder in order to effect the same steering movement in either the right or left direction. In a steering hardover position, either pore or starboard, the cylinder should bottom out in the direction of the turn. For the conventional or known steering mechanisms, a loss of hydraulic fluid will not alter this positioning. The relative position of the piston is particularly critical, however, in the case of utilizing power steering assist such as shown in co-pending application Ser. No. 08/422,893 now U.S. Pat. No. 5,603,279, and assigned to the same assignee, which is incorporated herein by reference. That is, in such a power steering system, any loss in hydraulic fluid can offset the position of the piston thereby resulting in the piston bottoming out in one direction only. Briefly, the teachings of that patent application disclose a power steering assist system comprising a hydraulic cylinder-piston assembly having a reciprocally mounted piston of unequal effective areas, and fluid passageways longitudinally or axially spaced to each side of the piston to form a first chamber and a second chamber in the cylinder, and valve control means to regulate the flow of hydraulic fluid through the power steering assist means. A fluid source means supplies pressurized hydraulic fluid to the cylinder. Steering at the helm actuates the valve control means for regulating the flow of pressurized hydraulic fluid through the cylinder, selectively controlled by the valve means, thereby reciprocating the piston in one direction or the other depending upon the steering direction. The resulting reciprocal movement of the piston is determined by the flow of pressurized fluid supplied to or exhausted from the chamber having the piston side of greater effective areas.

Hydraulic output means is operably connected to the power steering assist means for operative movement in response to the actuating input. The hydraulic output means, preferably comprising a cylinder-piston assembly, is actuated by the cylinder-piston of the power steering assist means, and therefore is commonly referred to in the art at the "slave cylinder." The steering member or mechanism is operatively connected to the output means and to the propulsion unit for effecting common movement of the steering member in response to steering actuation at the steering helm and to effect steering movement of the propulsion unit about the steering axis. Thus, steering movement at the helm effects common movement at the steering member to pivot the propulsion unit about a vertical steering axis. This embodiment of the invention is explained in greater detail hereinbelow.

It is important that the cylinder in the steering mechanism be in synchronism with the slave cylinder of the output means. That is, both pistons of each cylinder should bottom out in synchronism when in a hardover steering position. However, there can be a loss of oil in the slave cylinder and/or in the cylinder of the steering mechanism, or oil can leak past the seals and seep into the opposite chamber of the cylinder, thereby resulting in the delivery of less oil to the steering mechanism. As a result, the pistons of the two cylinders will not bottom out in synchronism.

This invention has as its purpose to provide a steering mechanism for a boat that effects steering of the propulsion unit in synchronism with steering at the helm, and hence will seek a center position.

SUMMARY OF THE INVENTION

Broadly, the present invention provides a steering mechanism operably connected to a propulsion unit, which comprises a hydraulic cylinder having opposed stop means, e.g., end caps, and is supported by a rod extending along the longitudinally axis of the cylinder. A piston is affixed to the support rod and mounted in the cylinder, and fluid passageways open to the cylinder and are spaced longitudinally to each side of the piston to form opposed chambers in the cylinder. The piston is provided with a longitudinal bore extending substantially parallel to the longitudinal axis of the cylinder, so that the bore establishes fluid communication between the opposed chambers. Valve means disposed in the bore is biased to a normally closed position, but actuated to an open position when the piston is brought into abutting relationship with a stop means thereby establishing fluid communication between the opposed chambers, the valve means and the fluid passageways.

In the conventional construction of a steering mechanism or steering member for an outboard, the hydraulic cylinder is movably mounted on a support rod, extending longitudinally of the cylinder, and affixed against movement by suitable bracketry. A steering arm or tiller arm extends fixedly from the hydraulic cylinder and is connected to the propulsion unit. When hydraulic fluid is selectively transported to either side of the piston mounted on the support rod, the cylinder moves causing accompanying movement of the steering arm, thereby effecting steering movement of the propulsion unit. In accordance with the present invention, the piston is provided with the longitudinal bore, and when steering in either direction is completed and the steering wheel is returned to center, the piston is returned to center.

The steering mechanism of the present invention is particularly applicable to a steering system for a marine vehicle having a power steering assist means such as disclosed in copending application Ser. No. 08/422,893, discussed above and in greater detail below. The power steering assist means includes a slave cylinder as the actuable output means. Pressurized hydraulic fluid is delivered or exhausted from the hydraulic cylinder of the steering mechanism via suitable fluid communication means between this cylinder and the slave cylinder. Thus, actuation of the power steering assist means actuates the slave cylinder, which in turn actuates the steering mechanism and thereby effects movement of the propulsion unit about its steering axis.

DETAILED DESCRIPTION OF THE INVENTION

Figure 1:
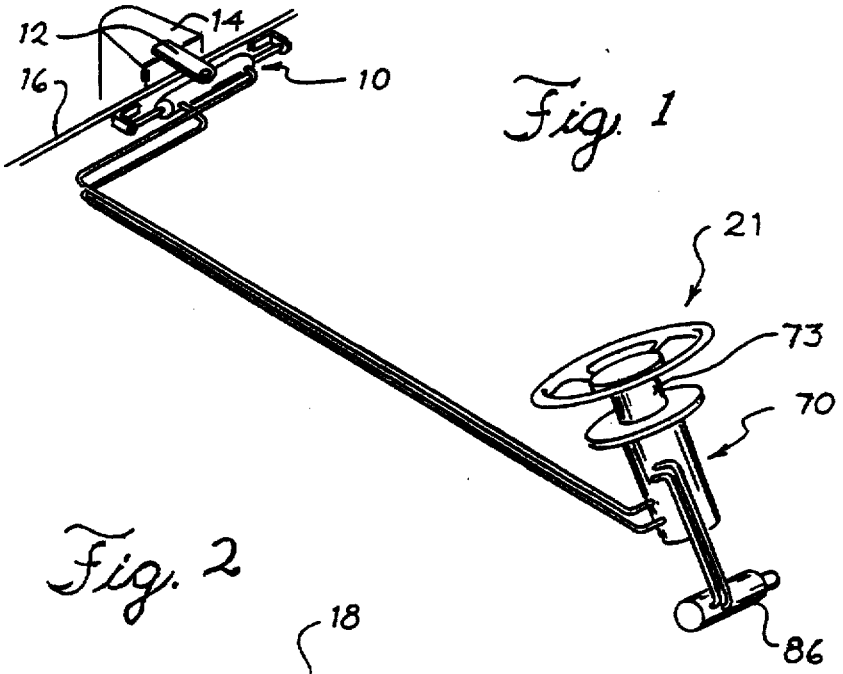
FIG. 1 is a schematic representation to show a steering arrangement utilizing the present invention for use in a marine vehicle.
Figure 2:
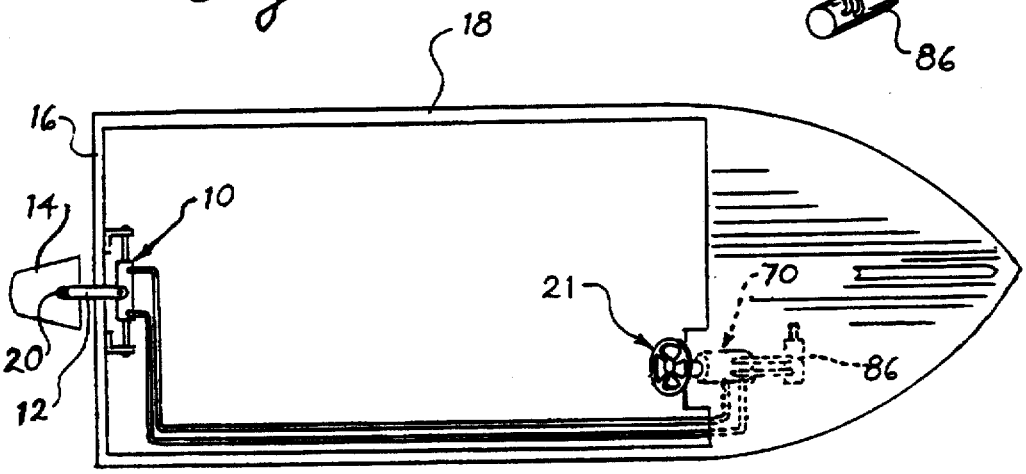
FIG. 2 is a diagrammatic plan view of a boat utilizing the structure of the invention.

Referring to the drawings wherein the same reference numerals refer to similar parts throughout the various views, there is shown in FIGS. 1 and 2 a hydraulic steering assembly or mechanism, indicated generally at 10, connected to a tiller arm or steering arm 12 of an outboard motor 14. The outboard motor or propulsion unit 14, which is generally of conventional construction, is adapted to be mounted to the transom 16 of a boat hull 18. FIG. 1 and 2 illustrate a steering member 10 for use in combination with a power steering assist means, discussed herein below in detail, which is a preferred embodiment of the invention, but it should be understood that the steering member can be used on a boat without a power steering assist means. In the conventional arrangement or design of an outboard, the propulsion unit or motor is mounted for pivotal movement about a vertical steering axis 20 (the steering axis envisioned as being substantially normal to the surface of the water). Actuation at the steering helm, indicated generally at 21, effects steering movement of the propulsion unit about the steering axis, as described hereinbelow in greater detail.

In the design or construction of a conventional outboard, the propulsion unit 14 also includes a suitable tilt means, indicated generally at 19, and described in detail in the aforesaid U.S. Pat. Nos. 4,373,920 and 4,773,882, for pivotally supporting the propulsion unit 14 from the transom for tilting movement about a horizontal tilt axis transverse to the steering axis. By reason of this construction, which is conventional and well known in the art, the propulsion unit can be rotated into and out of the water about the tilt axis without changing the relative position of the hydraulic steering assembly 10 with reference to the steering arm.

In order to effect steering of the propulsion unit 14 relative to the tilt means and transom about the steering axis 20 while, at the same time accommodating tilting about the horizontal tilt axis, there is provided the steering mechanism or assembly 10 comprising a hydraulic cylinder 22, which may be mounted on a bracket 23, and a support rod 24. In the embodiment illustrated, the support rod is fixed against movement relative to the cylinder, as explained below in greater detail, but where desired the cylinder may be fixed against movement relative to the support rod.

Figure 3:
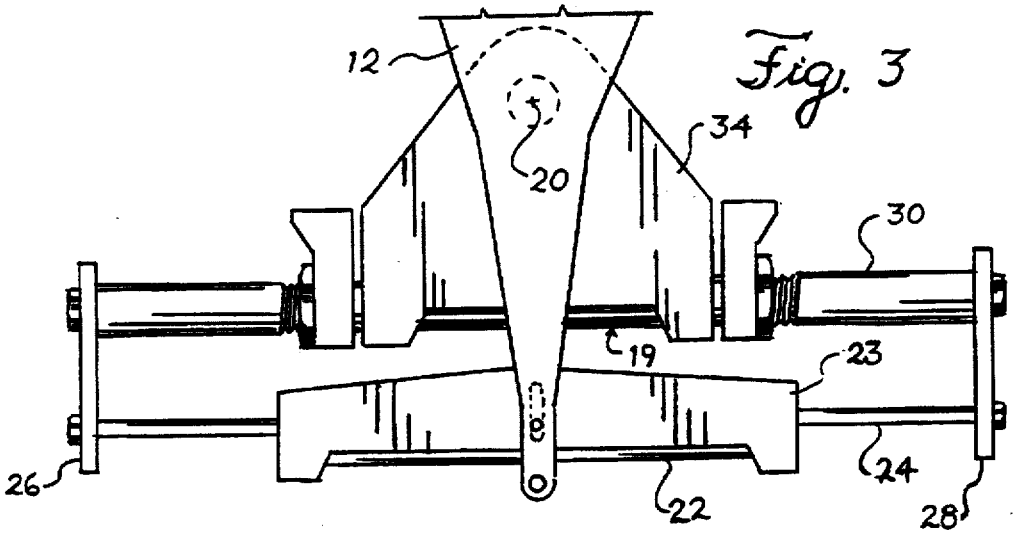
FIG. 3 is a plan view of the steering mechanism of the invention utilized in the outboard motor shown in FIG. 2.
Figure 4:
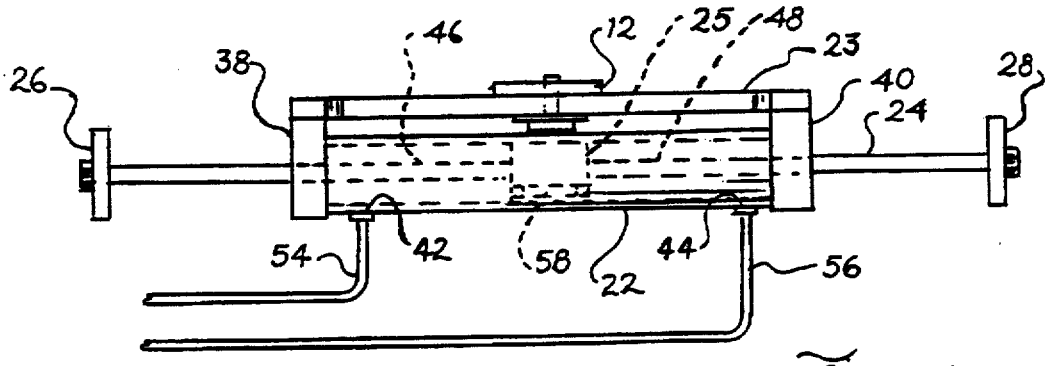
FIG. 4 is a front elevational view of the steering mechanism shown in FIG. 3.

It should be understood that the general design and construction for the cylinder and support rod and the means for mounting these members relative to the boat transom and the propulsion unit are known in the art, and thus these general features, per se, do not constitute the present invention. Suitable construction of a conventional or known steering mechanism, for example, is disclosed in the aforesaid U.S. Pat. Nos. 4,373,920 and 4,773,882. Hence, in the construction illustrated in FIGS. 3, 4, and 5, the elongated support rod 24 is fixedly supported against movement at its opposite ends by brackets 26 and 28 which extend rigidly and radially from oppositely disposed extensions 30 projecting laterally of the tilt tube 19. In a conventional construction, the tilt tube 19 is suitably fixed against axial movement relative to the swivel bracket 34, which is connected to the transom suitbale bracketry (not shwon) and is rotatable relative thereto so as to permit tilting in common with the swivel bracket.

The hydraulic cylinder 22 is moveable along the support rod 24 and is selectively displaced or moved depending upon the direction of turn at the steering helm. In the construction illustrated in detail in FIGS. 3, 4 and 7, the support rod 24, provided with a piston 25 affixed thereto and mounted centrally thereof, extends longitudinally through the hydraulic cylinder 22. The cylinder has opposed end caps or closures 38 and 40 through which the support rod extends, and fluid passageways 42 and 44 open to the cylinder and are longitudinally spaced to each side of the piston 25 to form a first chamber 46 and a second chamber 48 in the cylinder. A suitable fluid source means 86, having a suitable valve control means, and typically spaced from the steering mechanism, is in fluid communication with the hydraulic cylinder via conduits or lines 54 and 56 leading to passageways 42 and 44, respectively. A steering arm or tiller arm 12 is affixed at one end to bracket 23, and at the opposite end to propulsion unit 14.

Figure 5:
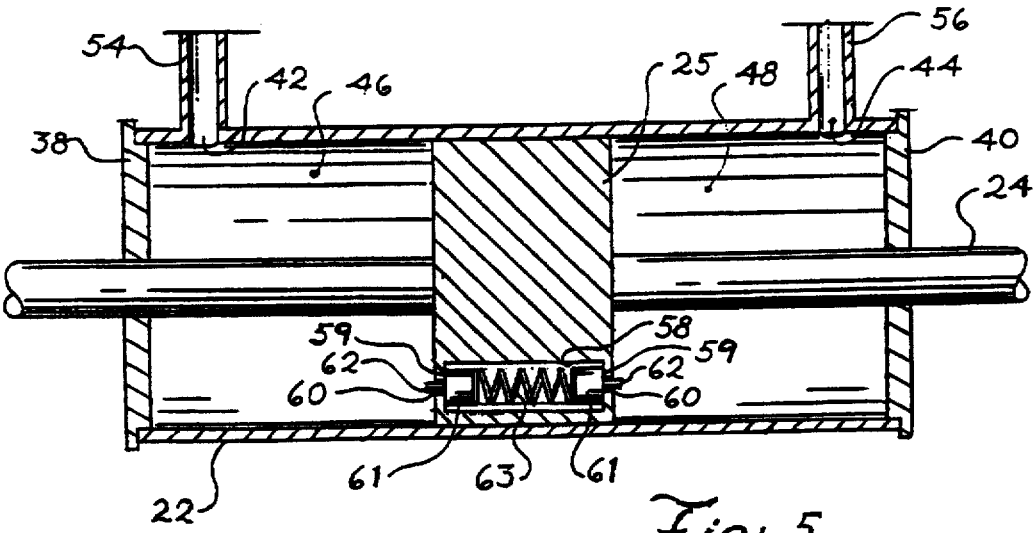
FIG. 5 is a side elevational view in cross-section showing in detail the steering mechanism of the present invention.

Referring now to FIG. 5, which shows in detail the features of the present invention, cylinder 22 is supported by longitudinal rod 24 having a piston 25 mounted thereon, thereby dividing the cylinder into first and second chambers 46 and 48. The piston 25 is provided with a longitudinal bore 58 extending substantially parallel to the longitudinal axis of the cylinder and opening to both sides of the cylinder. The bore terminates at opposed ends with a laterally disposed annular shoulder 59 having an opening 60. First and second valves 61, each having a projection 62, are spaced apart along the longitudinal axis of the bore, and seat against the annular shoulder 59. The valves are biased to a normally closed position by a suitable bias means such as coiled spring 63 so that each valve is maintained or seated in registration with the annular shoulder. As a result, the projections 61 extend outwardly from each valve through the openings 60. In operation, valves 61 are seated within the piston bore 58 in registration with shoulder 59 so that hydraulic fluid cannot pass or leak from one side of the piston to the opposite side. When pressurized hydraulic fluid enters one chamber of the cylinder 22, the cylinder moves along the support rod 24 thereby exhausting hydraulic fluid from the opposite chamber until the projection or pin 62 is brought into abutting engagement with an end cap of the cylinder. As a consequence, the valve is unseated thereby opening one side of the centering valve system of the steering mechanism. When the fluid pressure is great enough to unseat the opposite valve, hydraulic fluid will pass through the piston.

Thus, when the steering mechanism is actuated in response to steering at the helm, pressurized hydraulic fluid is selectively introduced to one chamber of the cylinder 22 and withdrawn from the other chamber of the cylinder. In this manner, the cylinder 22 is moveable relative to the piston and to the suuport red 24 and along the support rod in response to selective application of hydraulic fluid to the cylinder. That is, reciprocal movement of the cylinder 22 along the support rod is selectively controlled by supplying and exhausting hydraulic fluid through hydraulic conduits 54 and 56 leading from the fluid source means 50 connected to the cylinder adjacent the opposite ends thereof. Movement of cylinder 22 causes accompanying movement of the steering arm 12, thereby effecting steering movement of the propulsion unit 14 about the steering axis 20. In a neutral or no steering position, it is preferable that the volume of the slave cylinder be slightly greater than the volume of the cylinder for the steering mechanism, so that the slave cylinder does not bottom out before the steering mechanism, thereby assuring full travel of the steering mechanism. Where desired, the pressurized fluid source, including an appropriate valve means, can be located remotely from the outboard motor.

Figure 7:
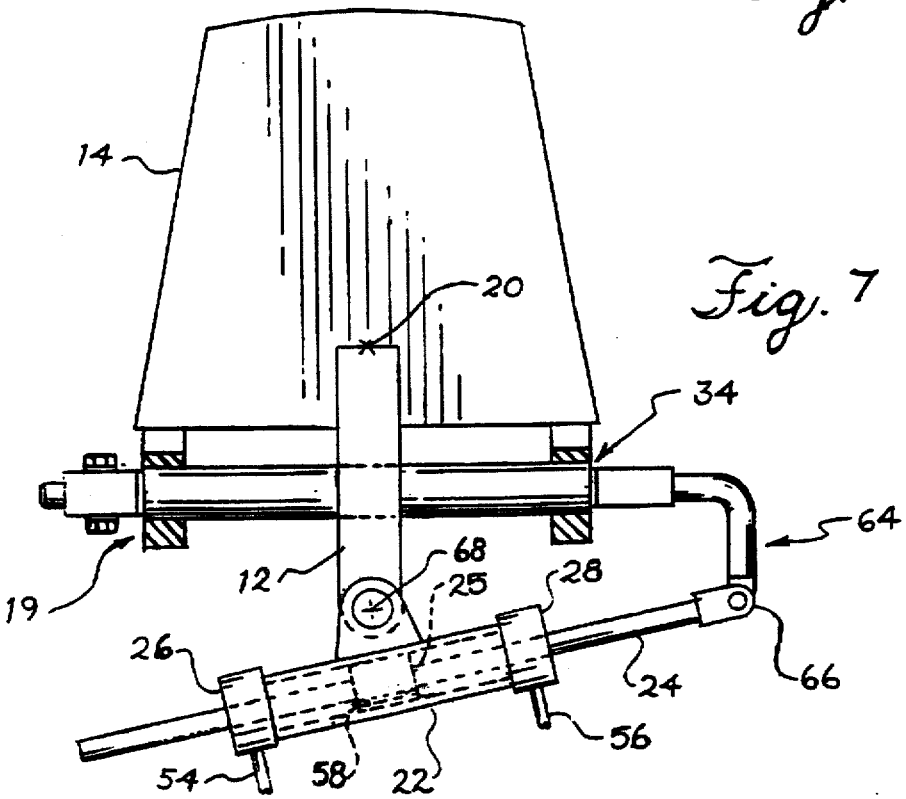
FIG. 7 is a plan view of an alternative embodiment of the present invention.

In an alternative design or construction as shown in FIG. 7, the steering assembly 10 includes a pivot means, indicated generally at 64 adapted for attachment to the stationary part of the engine bracket mounted to the boat. The pivot means 64 includes a pivotal connection 66 to the support rod 24 to define a pivot axis 68 generally parallel to the steering axis and nonrotatable about the steering axis 20 so that force exerted by actuation of the hydraulic cylinder 22 against the pivot means 64 rotates the propulsion unit 14 about the steering axis 20. In other words, the hydraulic cylinder 22 oscillates with the tiller arm 12, but the support rod 24 is stationary in relation to the engine and is not performing the steering motion.

In a preferred embodiment of the present invention, the steering mechanism or steering member 10 is operably connected with a power steering assist, indicated generally by the numeral 70. (See FIGS. 1, 2, and 6.) The power steering assist means is mounted on a boat operably interposed between the steering helm 21 and the propulsion unit 14 and mounted remotely from the propulsion unit. Steering wheel 22 is secured to steering shaft 73 which is operatively connected with the power steering assist means 70.

Figure 6:
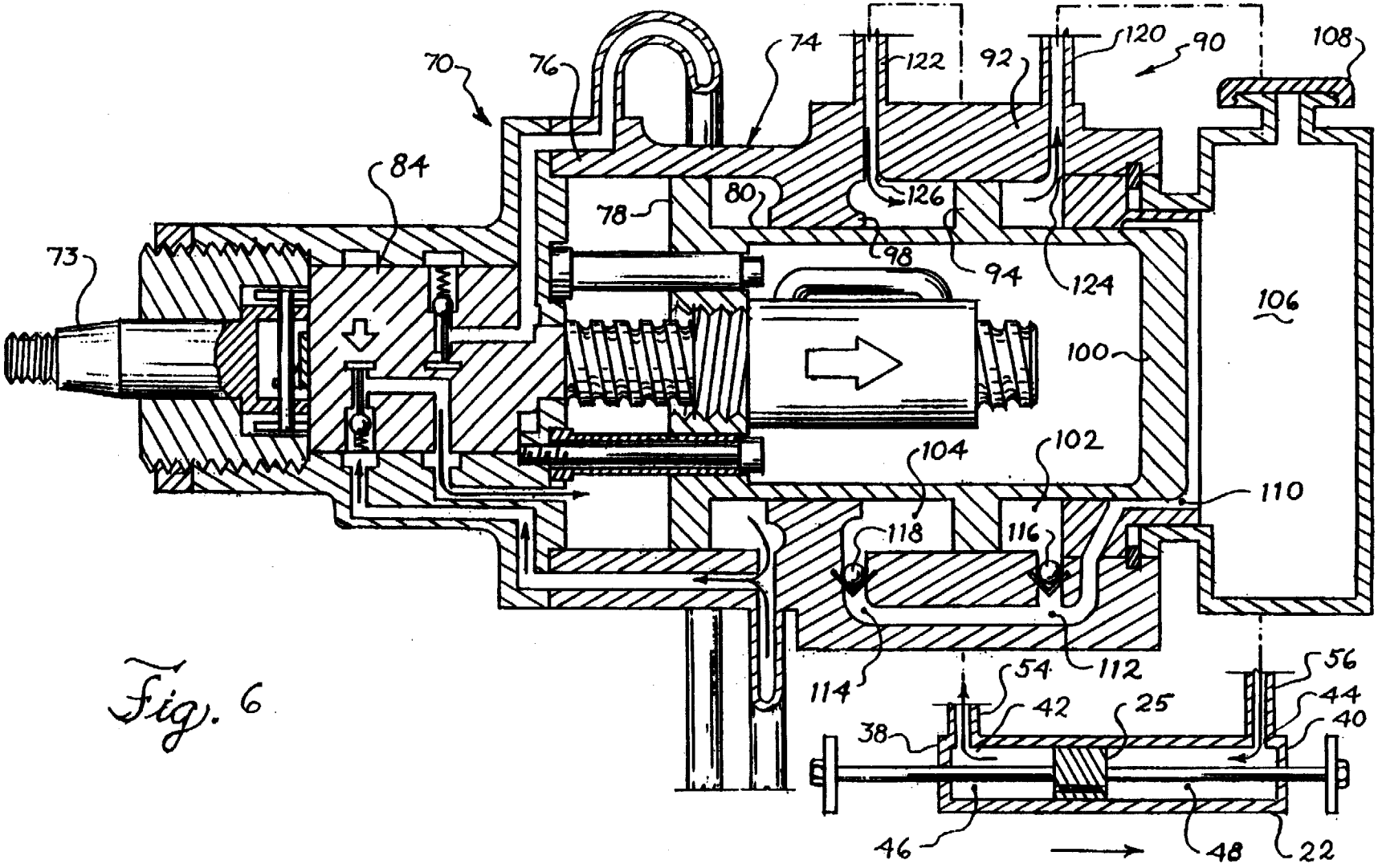
FIG. 6 is a side elevational view of a power steering assist means used in combination with the steering mechanism of the invention but showing movement of the parts for a right-turn direction.

In the illustrated embodiment as shown in greater detail in FIG. 6, and described in the aforesaid copending application Ser. No. 08/422,893, the power steering assist means 70 comprises a cylinder housing, indicated generally by the numeral 74, having a first hydraulic cylinder-piston assembly, indicated generally by the numeral 76, including reciprocating piston 78 mounted for reciprocating movement in the cylinder assembly 76. It will be observed that the effective areas for piston 78 are unequal. Annular ram rod 80 extends longitudinally from the piston head 78, where it is affixed. Cylindrical housing 70 receives valve means 84, and is operably connected at one end to steering shaft 73 and at the opposite end to the hydraulic cylinder-piston assembly 76 to control the supply of pressurized hydraulic fluid, e.g., oil, to the cylinder assembly.

When the hydraulic cylinder-piston assembly 76 is actuated in response to steering movement at the helm, pressurized hydraulic fluid, (e.g., pressurized oil) flows through the hydraulic cylinder assembly 76 delivered from the fluid source means 86. Torque from the propulsion unit 14 is overcome by the power steering assist means 70, thereby reducing the effort at the steering wheel to only the effort required to operate the hydraulic cylinder-piston assembly 76, which is independent of the torque generated by the propulsion unit.

Output means, indicated generally at 90, is operably connected to the hydraulic cylinder-piston assembly 76 and to the steering mechanism or assembly 10 of the propulsion unit 14. The output means comprises a second hydraulic cylinder-piston assembly 92, including reciprocating piston 94. Ram rod 80 extends to piston 94 and is affixed thereto. Thus, rotation of the steering wheel at the helm in one direction or the other actuates the valve means 84, which is operably connected to the first hydraulic cylinder-piston assembly 76 and provides power steering assist in response to actuation of the valve means. It will be observed that this input from the steering helm transfers the input to the power steering assist means. Reciprocal movement of piston 78 in turn reciprocates piston 94 thereby actuating the second hydraulic cylinder-piston assembly 92 of output means 90 to effect actuation of the steering mechanism 10. As explained above with reference to the other embodiments of the invention, actuation of the steering mechanism 10 causes accompanying movement of the steering arm 12, which in turn provides steering movement of the propulsion unit 14 about the steering axis 20.

Although a hydraulic output means 90 is housed in cylinder 74, and although shown as an integrally structured unit, it should be understood that the output means may be a separate unit actuably connected to the power steering assist means by suitable bracketry and hydraulic or mechanical connections. In the preferred embodiment as illustrated, the output means 90, positioned or arranged between the power steering assist means 70 and the steering mechanism 10 and disposed in housing 74, comprises the second cylinder-piston assembly 92 defined by the transverse internal wall 98 and end wall 100. As explained above, ram rod 80 projects axially from piston 78 through appropriate openings in walls 98 and 100, respectively. Piston 78, affixed or secured to the ram rod or formed integrally therewith and mounted for reciprocal movement, divides the second cylinder assembly 92 into annular chambers 102 and 104. Reservoir or tank 106, which holds hydraulic fluid (e.g., oil), is formed integrally with cylindrical housing 76 and disposed outwardly from end wall 100. Reservoir 106 may be provided with a screw threaded cap 108, as shown, in order to provide easy access in the event of the need to replenish any fluid losses.

Cylinder housing 74 is provided with a fluid passageway 110 that opens to the reservoir 106 to provide fluid communication between the reservoir and the second cylinder-piston assembly 92. Passageway 110 is branched at 112 to provide fluid communication with chamber 102, and at 114 to provide fluid communicationn with chamber 104. Suitable valving to control the flow of hydraulic fluid from the reservoir to the cylinder 92 comprises check valves 116 and 118, which are normally biased to a closed or neutral position. Such suitable check valves may be, for example, ball check valves, swing check valves, or the like, for selectively supplying hydraulic fluid to one chamber and draining fluid from the other.

The second cylinder-piston assembly 92 is also in fluid communication with steering mechanism or member 10 via hydraulic conduits or hoses 120 and 122. Thus, passageway 124 in cylinder housing 74 opens to annular chamber 102 and at the opposite end to hydraulic hose 120, and similarly, passageway 126 opens to annular chamber 104 and at the opposite end to hydraulic hose 122. Upon steering at the helm, reciprocally mounted piston 78 moves, such as to the right as shown in FIG. 6, which simultaneously moves piston 94 to the right. Hydraulic fluid (oil) is forced from annular chamber 102, through passageway 124 and hydraulic hose 120, and through conduit 56 and chamber 48 into the hydraulic cylinder 22 of steering member 10. As described above, steering mechanisms or members for outboard engines are well known and commercially available and are described in U.S. Pat. Nos. 4,373,920 and 4,773,882, which disclose hydraulic means for rotating the propulsion unit about a steering axis. Thus, oil entering cylinder 22 and against the piston 25 moves the cylinder to the right which, mounted with suitable bracketry, provides steering actuation to the propulsion unit. Reciprocal movement of the cylinder forces oil out of the opposite side of the cylinder (chamber 46) through conduit 54 and hydraulic hose 122, and oil is then forced into annular chamber 104. Steering at the helm in the opposite direction will effect movement of the cylinder in the opposite direction, thereby turning the propulsion unit in the opposite direction. In the event there is a loss of oil in either chamber 102 or 104, oil will be drawn by vacuum from reservoir 106, through fluid passageway 110 and check valves 116 or 118, and into the appropriate chamber depending on the direction of turn. Cap 108 is provided in order to have access to the reservoir to replenish it if there is any oil losses. In the event of a loss of hydraulic fluid in the steering mechanism, the slave cylinder 92 and the cylinder assembly 22 will not bottom out in synchronization. By reason of the present invention whereby hydraulic fluid is passed through the piston 24 during steering, a proper balance in fluid is always maintained, and the piston 24 is returned to center.

The foregoing detailed description has been given for clearness of understanding only, and no unnecessary limitations should be understood therefrom, as modifications will be obvious to those skilled in the art.

What is claimed is:

1. In a steering mechanism operably connected to the steering unit of a boat, which comprises (a) a hydraulic cylinder having opposed stop means, (b) a support rod extending along the longitudinally axis of said cylinder (c) a piston affixed to said support rod and mounted in said cylinder, and (d) fluid passageways opening to said cylinder and longitudinally spaced to each side of said piston to form opposed chambers in said cylinder, the improvement comprising:

(i) said piston adapted for reciprocal movement from a center position the full length of said cylinder and having a longitudinal bore extending substantially parallel to the longitudinal axis of said cylinder, said bore establishing fluid communication between said opposed chambers;

(ii) valve means disposed in said bore;

(iii) means to bias said valve means to a normally closed position; and (iv) means to open said valve means when said piston is brought into abutting relationship with a stop means thereby establishing fluid communication between said opposed chambers, said valve means and said fluid passageways to allow for the flow of hydraulic fluid in one direction only.

2. An actuable steering mechanism operably connected to a propulsion unit and actuated in response to an input member, which comprises (a) a hydraulic cylinder having opposed end caps, (b) a support rod extending longitudinally through said cylinder, (c) a piston affixed to said support rod and mounted in said cylinder, and (d) fluid passageways opening to said cylinder and longitudinally spaced to each side of said piston to form a first chamber and a second chamber in said cylinder, the improvement comprising:

(i) said piston adapted for reciprocal movement from a center position the full length of said cylinder and having a longitudinal bore extending substantially parallel to the longitudinal axis of said cylinder and terminating at each end of said bore with a laterally disposed annular shoulder having an opening;

(ii) first and second valves spaced apart along the longitudinal axis of said bore and each seated against said annular shoulder;

(iii) means to bias said first and second valves into registration with said annular shoulders to a normally closed position;

(iv) actuating means connected to said first and second valves and projecting through said openings to open a valve when said actuating means is brought into abutting relationship with an end cap in response to actuation of said input member, and hydraulic fluid pressure means to open the other valve, thereby establishing fluid communication between said first and second chambers, said valves and said fluid passageways to allow for the flow of hydraulic fluid in one direction only.

3. An actuable steering mechanism operably connected to a propulsion unit and actuated in response to an input member, which comprises (a) a hydraulic cylinder having opposed end caps, (b) a support rod extending longitudinally through said cylinder, (c) a piston affixed to said support rod and mounted in said cylinder, (d) fluid passageways opening to said cylinder longitudinally spaced to each side of said piston to form opposed chambers in said cylinder, and (e) means to selectively deliver pressurized hydraulic fluid to either of said opposed chambers and withdrawing hydraulic fluid from the other of said chambers, the improvement comprising:

(i) said piston adapted for reciprocal movement from a center position the full length of said cylinder and having a longitudinal bore extending substantially parallel to the longitudinal axis of said cylinder and terminating at opposed ends with a laterally disposed annular shoulder having an opening;

(ii) first and second valves spaced apart along the longitudinal axis of said bore and each valve seated against an annular shoulder;

(iii) means to bias said first and second valves into registration with said opposed shoulders to maintain said valves in a normally closed position;

(iv) a projection extending outwardly from each of said valves through said opposed openings to actuate either said first or second valves to an open position when pressurized hydraulic fluid is delivered to one of said opposed chambers to bring said projection into abuttment with an end cap in response to actuation of said input member and to raise said other valve from said shoulder thereby establishing fluid communication between said first and second chambers, said first and second valves and said fluid passageways to allow for the flow of hydraulic fluid in one direction only.

4. A steering mechanism operably connected to a propulsion unit which comprises (a) a hydraulic cylinder having opposed end caps and mounted for reciprocal movement on a support rod extending longitudinally therethrough, (b) a piston affixed to said support rod and mounted in said cylinder, and (c) fluid passageways opening to said cylinder and longitudinally spaced to each side of said piston to form opposed chambers in said cylinder, the improvement comprising:

(i) said piston adapted for reciprocal movement from a center position the full length of said cylinder and having a longitudinal bore extending substantially parallel to the longitudinal axis of said cylinder, said bore establishing fluid communication between said opposed chambers;

(ii) valve means disposed in said bore, (iii) means to bias said valve means to a normally dosed position; and (iv) means to open said valve means when said piston is brought into abutting relationship with an end cap in response to the application of pressurized hydraulic fluid to an opposed chamber thereby establishing fluid communication between said first and second chambers, said valve means and said fluid passageways to allow for the flow of hydraulic fluid in one direction only.

5. In a steering system for a marine vehicle having a power steering assist means and a propulsion unit pivotal about a steering axis, which comprises:

(a) a rotatable input member;

(b) a first hydraulic cylinder having a reciprocally mounted piston;

(c) fluid source means for supplying pressurized hydraulic fluid to said cylinder;

(d) valve control means operably connected to said input member and adapted to selectively control the flow of hydraulic fluid to said first cylinder whereby the resulting reciprocal movement of said piston is determined by the flow of pressurized fluid supplied to or exhausted from said first cylinder;

(e) a ram rod extending coaxially in said first cylinder from said piston and mounted for reciprocative movement upon reciprocal movement of said piston; and (f) a second hydraulic cylinder having a reciprocally mounted piston operably connected to said ram rod and actuated in response to reciprocal movement of said piston of said first cylinder; the improvement comprising a steering mechanism operably connected to said propulsion unit and including (i) a third hydraulic cylinder movably having opposed end caps and mounted on a support rod having a piston mounted in said cylinder to form opposed chambers in said cylinder;

(ii) fluid communication means between said second cylinder and said third cylinder for transporting pressurized fluid between said second cylinder and said third cylinder upon reciprocal movement of said piston of said second cylinder;

(iii) said piston of said third cylinder having a longitudinal bore extending substantially parallel to the longitudinal axis of said third cylinder, said bore establishing fluid communication between said opposed chambers;

(iv) valve means disposed in said bore;

(v) means to bias said valve means to a normally closed position; and (vi) means to open said valve means when said piston is brought into abutting relationship with an end cap thereby establishing fluid communication between said opposed chambers, said valve means and said fluid communication means, whereby movement of said third cylinder effects movement of said propulsion unit about said steering axis.

* * * * *